US011161341B2

(12) United States Patent
Min et al.

(10) Patent No.: US 11,161,341 B2
(45) Date of Patent: Nov. 2, 2021

(54) INKJET PRINTING SYSTEM

(71) Applicant: Samsung Display Co., LTD., Yongin-si (KR)

(72) Inventors: Hong Gi Min, Hwaseong-si (KR); Dong Sul Kim, Hwaseong-si (KR); Byoung-Hoon Choi, Hwaseong-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 16 days.

(21) Appl. No.: 16/854,901

(22) Filed: Apr. 22, 2020

(65) Prior Publication Data

US 2020/0384761 A1 Dec. 10, 2020

(30) Foreign Application Priority Data

Jun. 7, 2019 (KR) ..... 10-2019-0067322

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC ... B41J 2/04596; B41J 2/04593; B41J 2/0456
See application file for complete search history.

(56) References Cited

U.S. PATENT DOCUMENTS

| | | | | |
|---|---|---|---|---|
| 6,488,351 | B1 | 12/2002 | Newkirk et al. | |
| 2003/0020772 | A1* | 1/2003 | Morikawa | B41J 2/0458 347/10 |
| 2007/0070102 | A1* | 3/2007 | Takata | B41J 2/04588 347/10 |
| 2015/0210073 | A1* | 7/2015 | Yamagata | B41J 2/04596 347/10 |
| 2018/0288277 | A1 | 10/2018 | Kirchhoff et al. | |

FOREIGN PATENT DOCUMENTS

| | | |
|---|---|---|
| JP | 6024589 B2 | 9/2012 |
| JP | 6286671 B2 | 3/2018 |
| KR | 101022117 B1 | 3/2011 |

* cited by examiner

*Primary Examiner* — Lam S Nguyen
(74) *Attorney, Agent, or Firm* — Cantor Colburn LLP

(57) ABSTRACT

An inkjet printing system includes an inkjet head including first to n-th nozzles disposed in a row in a first direction, where the inkjet head discharges an ink onto a pixel printing target substrate, a transfer part which transfers the pixel printing target substrate toward the inkjet head in a second direction perpendicular to the first direction, a discharge waveform signal generator which generates different discharge waveform signals based on a pixel interval in the pixel printing target substrate and a transferring speed of the pixel printing target substrate, and a discharge waveform signal selector which selects first to n-th discharge waveform signals among the plurality of different discharge waveform signals based on discharge position error data respectively corresponding to the first to n-th nozzles, such that the first to n-th discharge waveform signals are selectively provided to each of the first to n-th nozzles.

16 Claims, 14 Drawing Sheets

INKJET PRINTING SYSTEM

This application claims priority to Korean Patent Application No. 10-2019-0067322, filed on Jun. 7, 2019, and all the benefits accruing therefrom under 35 USC § 119, the content of which in its entirety is herein incorporated by reference.

BACKGROUND

1. Field

Embodiments of the invention relate generally to an inkjet printing system. More particularly, embodiments relate to an inkjet printing system capable of correcting a position where an ink is discharged on a pixel printing target substrate.

2. Description of the Related Art

In general, an inkjet printing technology may be used to form pixels on a substrate for manufacturing a display device. An ink may be discharged to a pixel target substrate so that the pixels may be printed on a surface of the pixel printing target substrate. The inkjet printing technology may be classified into various types according to the ink discharging methods, and a piezoelectric inkjet printing technology is widely used. In a piezoelectric inkjet printing, a shape of a piezoelectric material is changed when an electric signal is applied thereto. A piezoelectric element including the piezoelectric material is used in the piezoelectric inkjet printing technology. For example, the ink may be discharged to the surface of the pixel printing target substrate through a nozzle by varying the shape of the piezoelectric element by applying the electric signal to the piezoelectric element in the piezoelectric inkjet printing technology.

SUMMARY

In a piezoelectric inkjet printing technology, a position where an ink is actually discharged to a pixel printing target substrate may be out of a target position by various reasons (for example, if the shapes of the nozzles are not uniform or the nozzles are not aligned properly), thus, a distance difference between the position where the ink is discharged and the target position may occur. To manufacture a display device with a high resolution, such a distance difference between the position where the ink is discharged and the target position is desired be reduced, such that it is desired to accurately control the position where the ink is discharged. A transferring speed of the pixel target substrate may be reduced to accurately control the position where the ink is discharged. However, when the transferring speed of the pixel target is reduced, a productivity of the display device may be reduced.

Exemplary embodiments provide an inkjet printing system capable of accurately control a position where an ink is discharged while maintaining a high transferring speed of a pixel printing target substrate in printing pixels on the surface of the pixel printing target substrate by discharging the ink to the pixel printing target substrate.

According to an exemplary embodiment, an inkjet printing system includes: an inkjet head including first to n-th nozzles disposed in a row in a first direction, where the inkjet head discharges an ink onto a pixel printing target substrate and n is an integer equal to or greater than two; a transfer part which transfers the pixel printing target substrate toward the inkjet head in a second direction perpendicular to the first direction; a discharge waveform signal generator which generates a plurality of different discharge waveform signals based on a pixel interval in the pixel printing target substrate and a transferring speed of the pixel printing target substrate; and a discharge waveform signal selector which selects first to n-th discharge waveform signals among the plurality of different discharge waveform signals based on discharge position error data respectively corresponding to the first to n-th nozzles such that the first to n-th discharge waveform signals are selectively provided to each of the first to n-th nozzles, where the first to n-th discharge waveform signals control discharge operations of the first to n-th nozzles.

In an exemplary embodiment, the discharge position error data may represent a distance difference between a test ink simultaneously discharged from the first to n-th nozzles to a reference line extending in the first direction and the reference line, in the second direction.

In an exemplary embodiment, the discharge position error data may be a digital signal, a reference bit string may be assigned to the reference line, and first to n-th bit strings may be assigned to the first to n-th nozzles, respectively, based on the distance difference.

In an exemplary embodiment, the reference line may be set for the pixel interval.

In an exemplary embodiment, the reference line may be set for each minimum discharge interval calculated based on a discharge frequency of the inkjet head and the transferring speed of the pixel printing target substrate.

In an exemplary embodiment, each of the plurality of different discharge waveform signals may have an activating duration and stable duration, and when the stable duration of a first discharge waveform signal finishes, the activating duration of a second discharge waveform signal may start.

In an exemplary embodiment, the discharge waveform signal selector may include first to n-th signal selection units which select the first to n-th discharge waveform signals.

In an exemplary embodiment, the discharge position error data of the first to n-th nozzles may be respectively applied to the first to n-th signal selection units.

In an exemplary embodiment, the inkjet head may further include first to n-th piezoelectric elements disposed corresponding to the first to n-th nozzles, respectively, and shapes of the first to n-th piezoelectric elements may be varied in response to the first to n-th discharge waveform signals, respectively.

According to an exemplary embodiment, an inkjet printing system includes: an inkjet head including first to n-th nozzles disposed in a row in a first direction, where the inkjet head discharges an ink onto a pixel printing target substrate and n is an integer equal to or greater than two; a transfer part which transfers the pixel printing target substrate toward the inkjet head in a second direction perpendicular to the first direction; and a discharge waveform signal generator which generates first to n-th discharge waveform signals based on a pixel interval in the pixel printing target substrate, a transferring speed of the pixel printing target substrate and discharge position error data respectively corresponding to the first to n-th nozzles, such that the first to n-th discharge waveform signals are selectively provided to each of the first to n-th nozzles.

In an exemplary embodiment, the discharge position error data may represent a distance difference between a test ink simultaneously discharged from the first to n-th nozzles to a reference line extending in the first direction and the reference line, in the second direction.

In an exemplary embodiment, the discharge position error data may be a digital signal, a reference bit string may be assigned to the reference line, and first to n-th bit strings may be respectively assigned to the first to n-th nozzles according to the distance difference.

In an exemplary embodiment, the reference line may be set for the pixel interval.

In an exemplary embodiment, the reference line may be set for each minimum discharge interval calculated based on a discharge frequency of the inkjet head and the transferring speed of the pixel printing target substrate.

In an exemplary embodiment, each of the first to n-th discharge waveform signals may have an activating duration and stable duration, and when the stable duration of the first discharge waveform signal finishes, the activating duration of the second discharge waveform signal may start.

In an exemplary embodiment, the inkjet head may further include first to n-th piezoelectric elements disposed corresponding to the first to n-th nozzles, respectively, and shapes of the first to n-th piezoelectric elements may be varied in response to the first to n-th discharge waveform signals, respectively.

In embodiments of the invention, an inkjet printing system may selectively provide the first to n-th discharge waveform signals to each of the first to n-th nozzles in response to the discharge position error data of the ink respectively discharged from the first to n-th nozzles of the inkjet head, such that the first to n-th nozzles may respectively discharge the ink at a controlled time interval, and the inkjet printing system may accurately control a position where the ink is discharged while maintaining high transferring speed of the pixel printing target substrate in printing pixels on the surface of the pixel printing target substrate.

Therefore, an inkjet printing system may selectively provide the first to n-th discharge waveform signals to each of the first to n-th nozzles in response to the discharge position error data of the ink respectively discharged from the first to n-th nozzles of the inkjet head, such that the first to n-th nozzles may respectively discharge the ink at a controlled time interval, and the inkjet printing system may accurately control a position where the ink is discharged while maintaining high transferring speed of the pixel printing target substrate in printing pixels on the surface of the pixel printing target substrate.

BRIEF DESCRIPTION OF THE DRAWINGS

Illustrative, non-limiting exemplary embodiments of the invention will be more clearly understood from the following detailed description in conjunction with the accompanying drawings, in which.

DETAILED DESCRIPTION

Figure 1A:
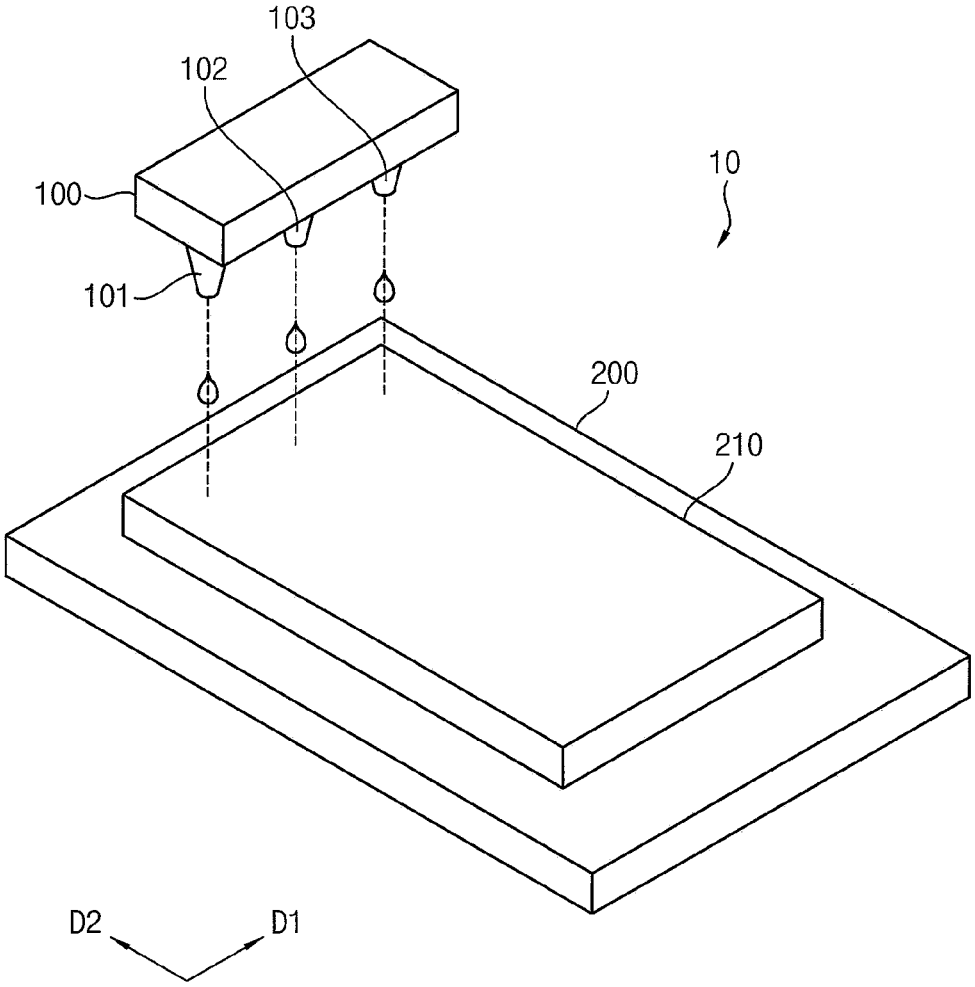
FIG. 1A and FIG. 1B are diagrams illustrating an inkjet printing system according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, embodiments of the invention will be described in detail with reference to the accompanying drawings.

Figure 1B:
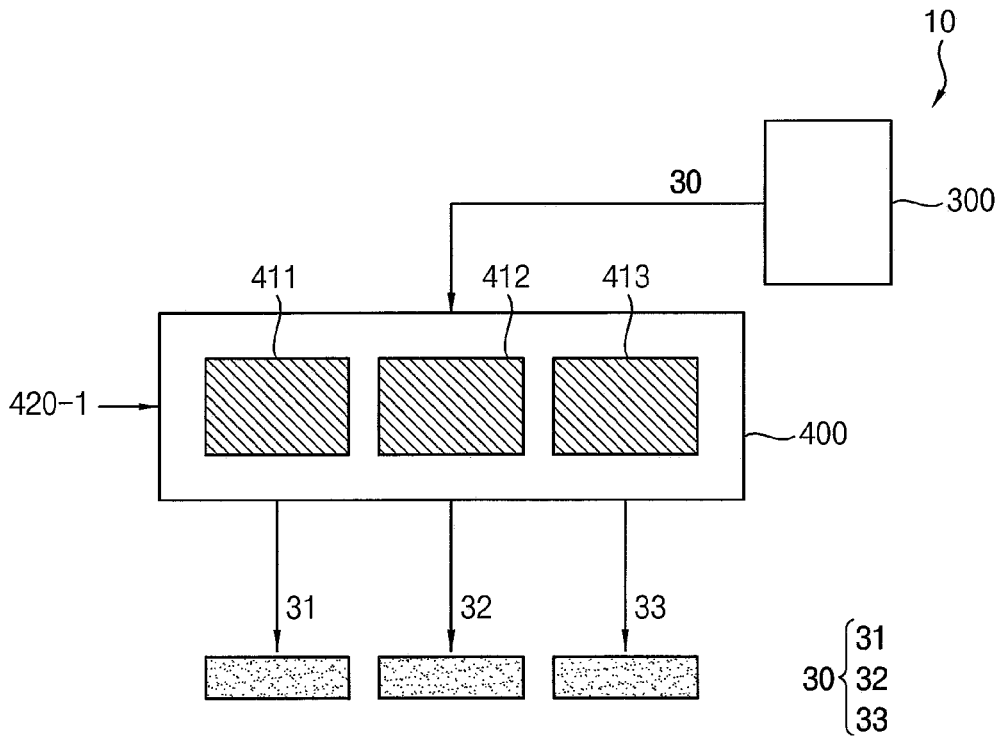
Figure 2:
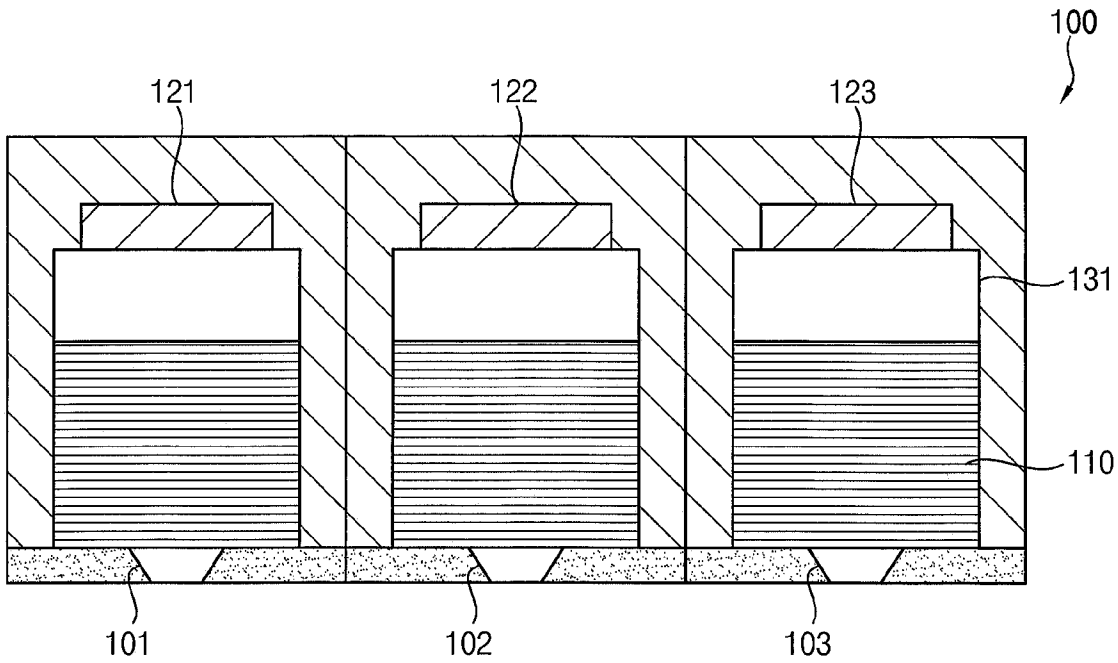
FIG. 2 is a diagram illustrating an exemplary embodiment of an inkjet head included in the inkjet printing system of FIG. 1A and FIG. 1B.

FIG. 1A and FIG. 1B are diagrams illustrating an inkjet printing system according to an exemplary embodiment. FIG. 2 is a diagram illustrating an exemplary embodiment of an inkjet head included in the inkjet printing system of FIG. 1A and FIG. 1B.

Referring to FIG. 1A, FIG. 1B and FIG. 2, an exemplary embodiment of the inkjet printing system 10 may include an inkjet head 100, a transfer part 200, a discharge waveform signal generator 300, and a discharge waveform signal selector 400.

In an exemplary embodiment, the inkjet head 100 may include first to third nozzles 101, 102 and 103, an ink 110, first to third piezoelectric elements 121, 122 and 123, and an pressure chamber 131. The first to third nozzles 101, 102 and 103 may be disposed in a row in a first direction D1, and the first to third nozzles 101, 102 and 103 may discharge the ink 110 in the form of droplets onto a pixel printing target substrate 210.

The ink 110 may be a liquid including various materials. In an exemplary embodiment, the ink 110 may be an organic light emitting ink for forming a pixel included in an organic light emitting display device. In one exemplary embodiment, for example, the organic light emitting ink may include an organic light emitting material and a solvent which are mixed with each other. In such an embodiment, the organic light emitting material may be a red organic light emitting material, a green organic light emitting material, or a blue organic light emitting material. The organic light emitting material may receive a voltage to emit light having a color (e.g., red, green or blue). The solvent may be easily mixed with the organic light emitting material such that the organic light emitting material may be dissolved into the solvent to be in a liquid state.

The first to third piezoelectric elements 121, 122 and 123 may be disposed corresponding to the first to third nozzles 101, 102 and 103, respectively, and may be disposed above the pressure chamber 131. The first to third piezoelectric elements 121, 122 and 123 may include piezoelectric bodies. The shapes of the first to third piezoelectric elements 121, 122 and 123 are changed in response to provided discharge waveform signals, respectively.

The pressure chamber 131 may store the ink 110 to be discharged from the first to third nozzles 101, 102 and 103, and may be connected to outside through the first to third nozzles 101, 102 and 103. A diaphragm (not shown) may be disposed between each of the first to third piezoelectric elements 121, 122 and 123 and the pressure chamber 131, and may transmit vibration to the pressure chamber 131 in response to change of shape of each of the first to third piezoelectric elements 121, 122 and 123.

In such an embodiment, when the shapes of the first to third piezoelectric elements 121, 122 and 123 are respectively changed in response to the discharge waveform signals, a volume of the pressure chamber 131 may be reduced. When the volume of the pressure chamber 131 is reduced, the inkjet head 100 may discharge the ink 110 through the first to third nozzles 101, 102 and 103. Accordingly, the first to third nozzles 101, 102 and 103 of the inkjet head 100 may discharge the ink 110 to the outside in response to the discharge waveform signals, respectively.

FIGS. 1A, 1B and 2 show an exemplary embodiment where the inkjet head 100 includes the first to third nozzles 101, 102 and 1032, but the invention is not limited thereto. In one alternative exemplary embodiment, for example, the inkjet head 100 may include a plurality of nozzles addition to the first to third nozzles 101, 102 and 103.

The frequency at which the inkjet head 100 discharges the ink 110 to the outside (hereinafter, referred to a discharge frequency) may depend on the characteristics of the inkjet head 100. That is, the discharge frequency of the inkjet head 100 may not be arbitrary adjusted. In addition, the time for a current droplet to be discharged after a previous one to be discharged from a nozzle may be determined based on the discharge frequency of the inkjet head 100. According to an exemplary embodiment, the discharge frequency of the inkjet head 100 may be about 30 kilohertz (kHz), for example. In such an embodiment, each of the first to third nozzles 101, 102 and 103 may discharge the ink 110 about 30,000 times per second. In such an embodiment, each of the first to third nozzles 101, 102 and 103 may spend at least about 33.3 microseconds (us) for discharging one droplet after discharging the previous one.

The transfer part 200 may transfer the pixel printing target substrate 210 in a second direction D2 perpendicular to the first direction D1. The pixel printing target substrate 210 may be disposed below the inkjet head 100 by the transfer part 200, and the ink 110 may be discharged onto the pixel printing target substrate 210 by the first to third nozzles 101, 102 and 103 of the inkjet head 100.

The pixel printing target substrate 210 may be a test substrate for determining a position where the ink 110 is discharged or a substrate for manufacturing the organic light emitting display device. In an exemplary embodiment where the pixel printing target substrate 210 is the substrate for manufacturing the organic light emitting display device, the ink 110 may be the organic light emitting ink as described above, and the pixel printing target substrate may include a plurality of banks for defining a region where sub-pixels are formed. The organic light emitting ink may form the sub-pixels by being discharged between adjacent banks. In one exemplary embodiment, for example, the sub-pixels may include a red sub-pixel, a green sub-pixel, and a blue sub-pixel. The sub-pixels may be formed at a uniform interval in the second direction D2 (hereinafter, referred to a pixel interval) of the pixel printing target substrate 210. In one exemplary embodiment, for example, one red sub-pixel may be formed to be spaced apart from an adjacent red sub-pixel by about 75 micrometers (um) in the second direction D2.

The transfer part 200 may transfer the pixel printing target substrate 210 toward the inkjet head 100, and the speed of an inkjet printing process may be determined according to the transferring speed of the pixel printing target substrate 210. In one exemplary embodiment, for example, the transferring speed of the pixel printing target substrate 210 may be about 450 millimeters per second (mm/s). The speed of the inkjet printing process having the transferring speed of the pixel printing substrate 210 of about 450 mm/s may be about 3 times faster than the speed of an inkjet printing process having the transferring speed of the pixel printing substrate 210 of about 150 mm/s.

A minimum discharge interval (d) may be calculated by dividing the transferring speed (v) by the discharge frequency (f) of the inkjet head 100 (i.e., d=v/f). In one exemplary embodiment, for example, the minimum discharge interval may be about 15 um when the discharge frequency of the inkjet head 100 is about 30 kHz and the transferring speed of the pixel printing target substrate 210 is about 450 mm/s.

Figure 3:
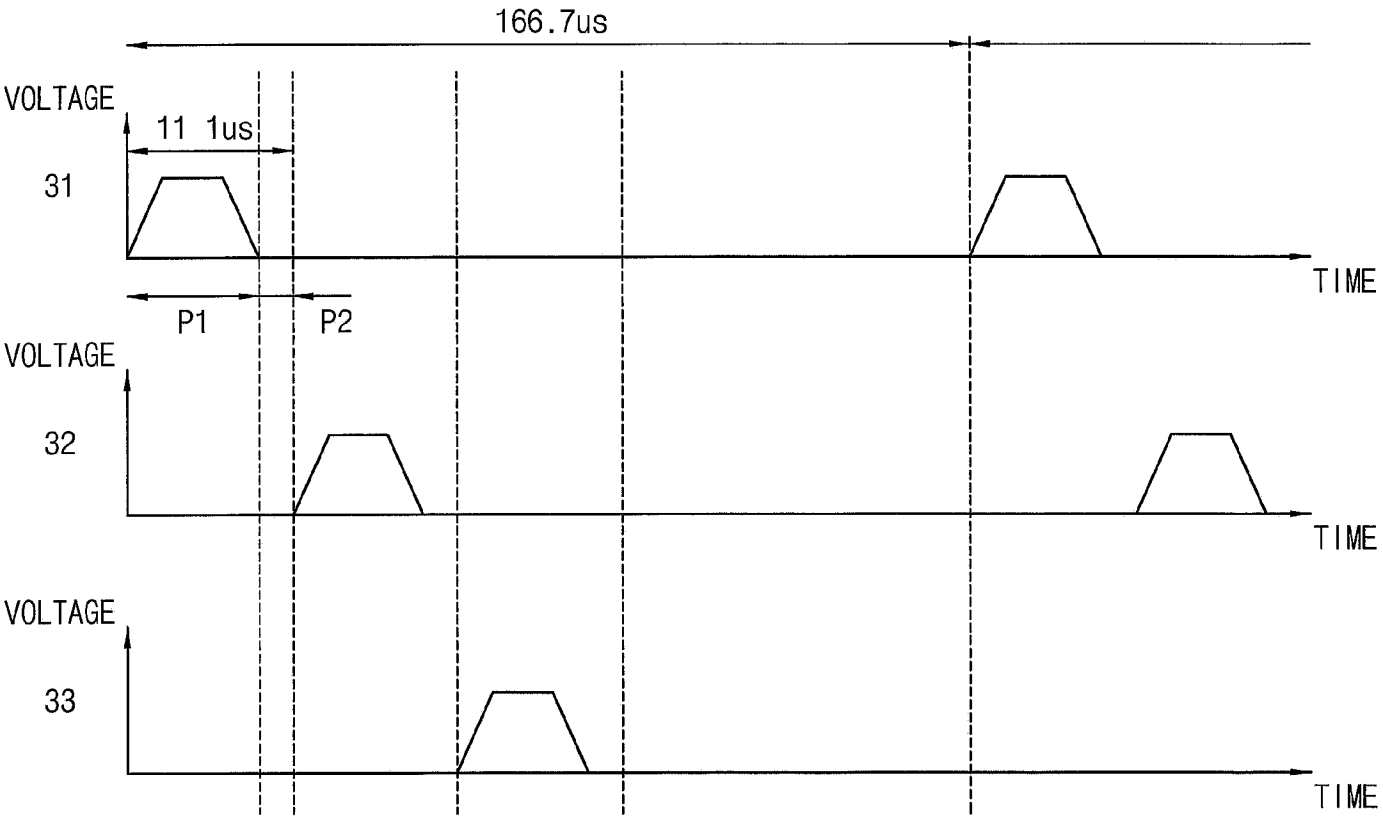
FIG. 3 is a waveform diagram illustrating an exemplary embodiment of a plurality of discharge waveform signals generated by a discharge waveform signal generator included in the inkjet printing system of FIG. 1A and FIG. 1B.

FIG. 3 is a waveform diagram illustrating an exemplary embodiment of a plurality of discharge waveform signals generated by a discharge waveform signal generator included in the inkjet printing system of FIG. 1A and FIG. 1B.

Referring to FIG. 1A, FIG. 1B and FIG. 3, an exemplary embodiment of the discharge waveform signal generator 300 may generate a plurality of different discharge waveform signals 30 based on the pixel interval in the pixel printing target substrate 210 and the transferring speed of the pixel printing target substrate 210. In one exemplary embodiment, for example, the discharge waveform signal generator 300 may generate the different discharge waveform signals 30 by dividing one discharge waveform signal, which is applied for a time interval for one droplet to be discharged after the previous droplet discharged from one nozzle, into a plurality of discharge waveform signals.

Each of the different discharge waveform signals 30 may have an activating duration P1 and a stable duration P2 following the activating duration P1. The activating duration P1 may include a rising portion, a holding portion, and a falling portion. The ink 110 may be discharged from the nozzle based on the discharge waveform signal. The stable duration P2 may be a time duration between an end of the activating duration P1 of a first discharge waveform signal and a start of the activating duration P1 of a second discharge waveform signal. That is, the activating duration P1 of one discharge waveform signal of the different discharge waveform signals 30 may start after the stable duration P2 of the other discharge waveform signal finishes.

In an exemplary embodiment, the discharge waveform signal generator 300 may generate the different discharge waveform signals 30 based on the pixel interval (e.g. about 75 um) and the transferring speed (e.g. about 450 mm/s). In one exemplary embodiment, for example, the discharge waveform signal generator 300 may generate three different discharge waveform signals 30 by dividing one discharge waveform signal applied for 33.3 us, which is the time spent for one droplet to be discharged after the previous droplet discharged from one nozzle, into three discharge waveform signals. In an exemplary embodiment, as shown in FIG. 3, each of the different discharge waveform signals 30 may start the activating duration P1 every 166.7 us, and may have the activating duration P1 and the stable duration P2 for 11.1 us.

In an exemplary embodiment, as shown in FIG. 3, the discharge waveform signal generator 300 generates the first to third discharge waveform signals 31, 32 and 33, but the invention is not limited thereto. Alternatively, the discharge waveform signal generator 300 may generate four or more discharge waveform signals 30 in consideration of the characteristic of the ink 110. In an exemplary embodiment, the length of the activating duration P1 and/or the stable duration P2 shown in FIG. 3 may be variously controlled or modified, e.g., shortened or extended from those shown in FIG. 3.

Figure 4:
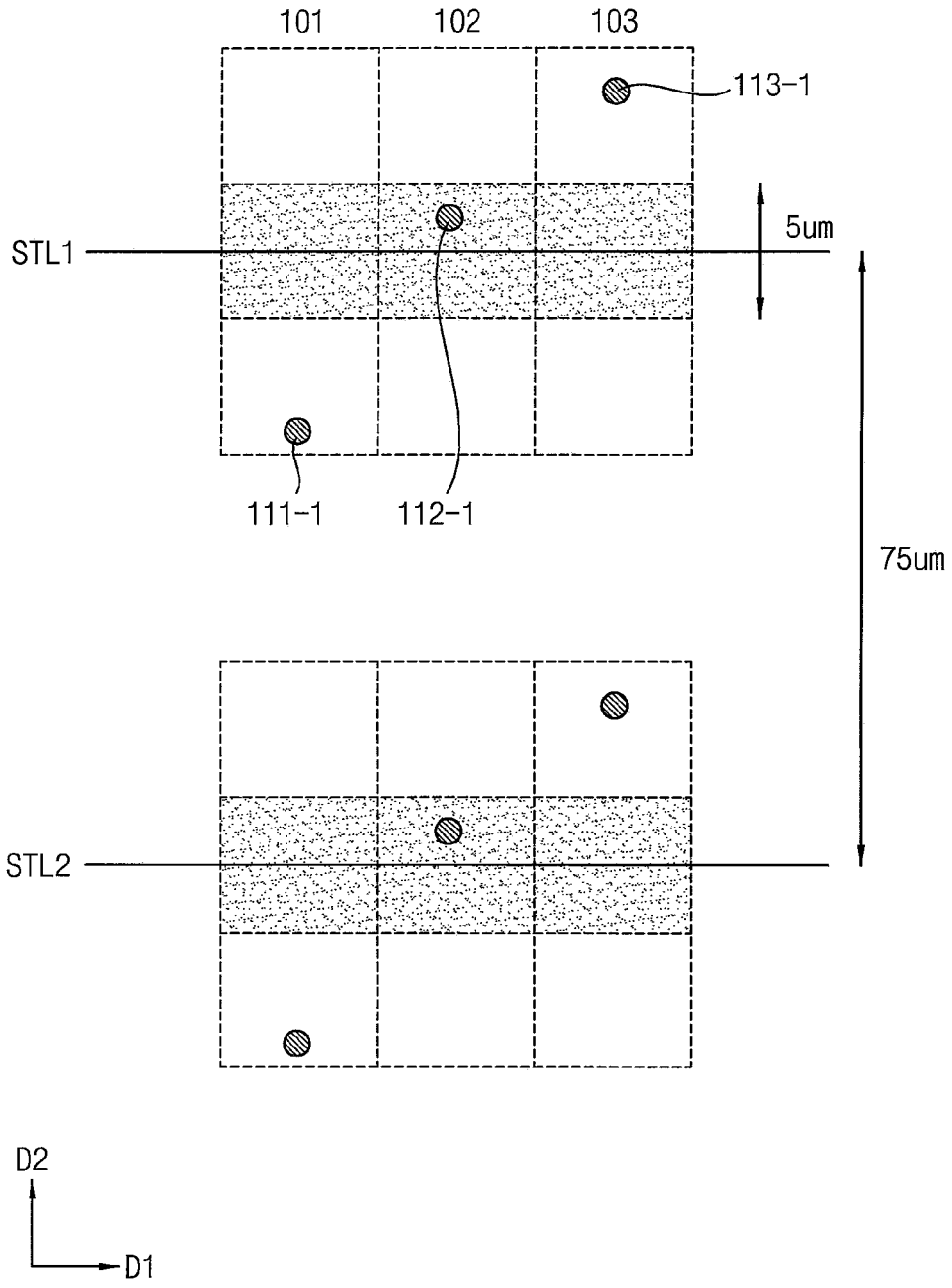
FIG. 4 is a diagram illustrating an exemplary embodiment of positions where test inks are discharged in the inkjet printing system of FIG. 1A and FIG. 1B.
Figure 5:
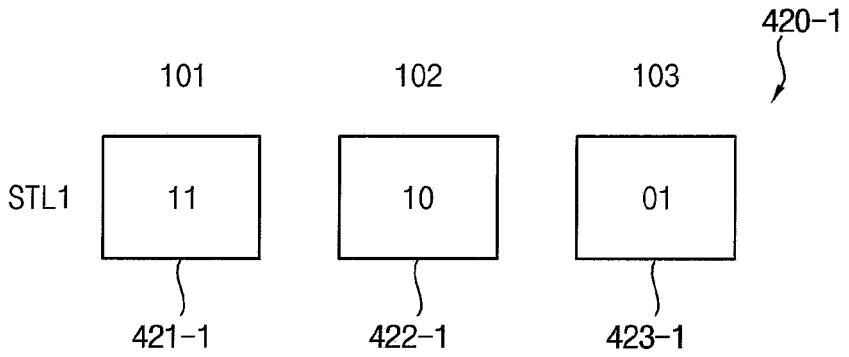
FIG. 5 is a diagram illustrating an exemplary embodiment of discharge position error data received by a discharge waveform signal selector included in the inkjet printing system of FIG. 1A and FIG. 1B.
Figure 6:
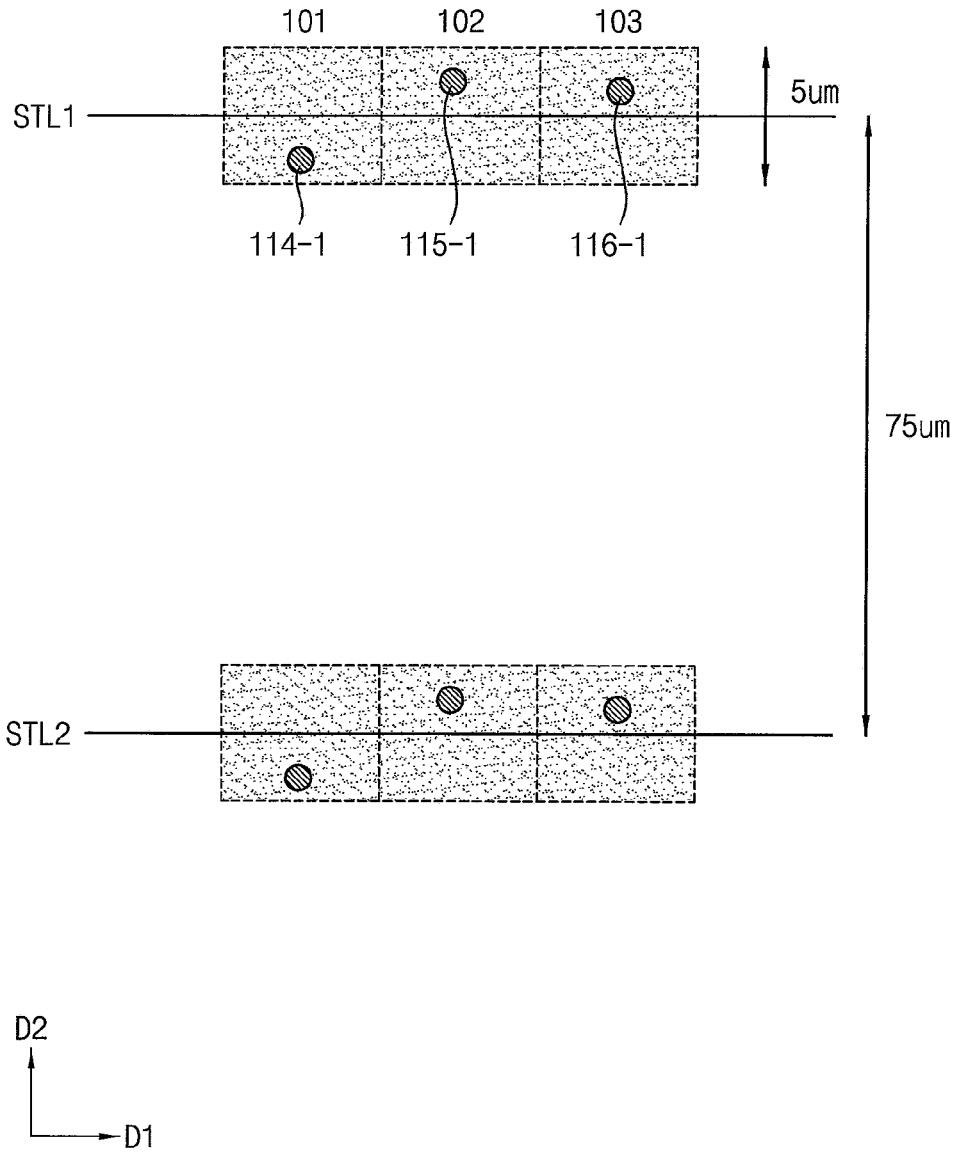
FIG. 6 is a diagram illustrating positions where actual inks are discharged in an exemplary embodiment of the inkjet printing system of FIG. 1A and FIG. 1B.

FIG. 4 is a diagram illustrating an exemplary embodiment of positions where test inks are discharged in the inkjet printing system of FIG. 1A and FIG. 1B. FIG. 5 is a diagram illustrating an exemplary embodiment of discharge position error data received by a discharge waveform signal selector included in the inkjet printing system of FIG. 1A and FIG. 1B. FIG. 6 is a diagram illustrating positions where actual inks are discharged in an exemplary embodiment of the inkjet printing system of FIG. 1A and FIG. 1B.

Referring to FIG. 1A, FIG. 1B, FIG. 4 and FIG. 6, in an exemplary embodiment, the pixel printing target substrate 210 may be a test substrate 211, and the test substrate 211 may be provided with a first reference line STL1 and a second reference line STL2. Each of the first reference line STL1 and the second reference line STL2 may extend in the first direction D1, and may be arranged with regular intervals in the second direction D2. In an exemplary embodiment, the first and second reference lines STL1 and STL2 may be set for each the pixel interval in the pixel printing target substrate 210. The pixel interval may be predetermined, for example, to be about 75 um.

The first to third nozzles 101, 102 and 103 may simultaneously discharge first to third test inks 111-1, 112-1 and 113-1 toward the first reference line STL1. Next, the first to third nozzles 101, 102 and 103 may simultaneously discharge test inks toward the second reference line STL2. However, the positions where the first to third test inks 111-1, 112-1 and 113-1 are discharged to the test substrate 211 may be out of the first and second reference lines STL1 and STL2 by a variety of reasons (for example, when the shapes of the first to third nozzles 101, 102 and 103 are different or the first to third nozzles 101, 102 and 103 are not aligned properly).

In an exemplary embodiment, as shown in FIG. 4, the first test ink 111-1 discharged from the first nozzle 101 may be discharged spaced apart from the first reference line STL1 about 7 um in a direction opposite to the second direction D2. The second test ink 112-1 discharged from the second nozzle 102 may be discharged spaced apart from the first reference line STL1 about 1.5 um in the second direction D2. The third test ink 113-1 discharged from the third nozzle 103 may be discharged spaced apart from the first reference line STL1 about 6 um in the second direction D2. This may be the same at the second reference line STL2. Hereinafter, the first to third test inks 111-1, 112-1 and 113-1 discharged toward the first reference line STL1 will be mainly described.

To manufacture a display device having high resolution, the ink 110 may be discharged within a predetermined margin of error in the first reference line STL1. In one exemplary embodiment, for example, the margin of error may be about ±2.5 um of the first reference line STL1.

Discharge position error data 420-1 may indicate a distance difference between the first to third test inks 111-1, 112-1 and 113-1 and the first reference line STL1 in the second direction D2, and may respectively correspond to the first to third nozzles 101, 102 and 103. In an exemplary embodiment, the discharge position error data 420-1 may be a digital signal, and a reference bit string may be assigned to the first reference line STL1. First to third bit string 421-1, 422-1 and 423-1 may be assigned to the first to third nozzles 101, 102 and 103 according to the distance difference.

As shown in FIG. 5, the positions where the first to third test inks 111-1, 112-1 and 113-1 are discharged onto the test substrate 211 may be converted into the discharge position error 420-1. The reference bit string and the first to third bit string 421-1, 422-1 and 423-1 of the discharge position error data 420-1 may be represented by two binary digits, respectively. In an exemplary embodiment, the reference bit string may be assigned to the first reference line STL1. In one exemplary embodiment, for example, the reference bit string may be '10'. In such an embodiment, the first bit string 421-1 of '11' may be assigned to the first nozzle 101 which discharges the first test ink 111-1, the second bit string 422-1 of '10' may be assigned to the second nozzle 102 which discharges the second test ink 112-1, and the third bit string 423-1 of '01' may be assigned to the third nozzle 103 which discharges the third test ink 113-1.

The discharge waveform signal selector 400 may select first to third discharge waveform signals 31, 32 and 33 for controlling discharge operations of the first to third nozzles 101, 102 and 103 based on the discharge position error data 420-1 respectively corresponding to the first to third nozzles 101, 102 and 103 among the different discharge waveform signals 30, and the discharge waveform signal selector 400 may provide the first to third discharge waveform signals 31, 32 and 33 to the first to third nozzles 101, 102 and 103. In an exemplary embodiment, the discharge waveform signal selector 400 may include first to third signal selection units 411, 412 and 413. Each of the first to third signal selection units 411, 412 and 413 may be a multiplexer which is inputted a plurality of signals and outputs one of the signals. The first to third signal selection units 411, 412 and 413 may receive the discharge position error data 420-1 respectively corresponding to the first to third nozzles 101, 102 and 103, and may select the first to third discharge waveform signals 31, 32 and 33 for controlling discharge operations of the first to third nozzles 101, 102 and 103 among the different discharge waveform signals 30. Next, the first to third signal selection units 411, 412 and 413 may respectively provide the first to third discharge waveform signals 31, 32 and 33 to the first to third nozzles 101, 102 and 103.

In an exemplary embodiment, as shown in FIG. 1B and FIG. 6, the discharge waveform signal selector 400 may select the first discharge waveform signal 31, and may provide the first discharge waveform signal 31 to the first nozzle 101 based on the first bit string 421-1. First ink 114-1 may be discharged to a position adjusted to be about 5 um in the second direction D2 from the position where the first test ink 111-1 is discharged by discharging the first ink 114-1 from the first nozzle 101 provided with the first discharge waveform signal 31. such an embodiment, the first ink 114-1 may be discharged at a position spaced apart about 2 um from the first reference line STL1 in the second direction D2. In such an embodiment, the discharge waveform signal selector 400 may select the second discharge waveform signal 32, and may provide the second discharge waveform signal 32 to the second nozzle 102 based on the second bit string 422-1. The second nozzle 102 provided with the second discharge waveform signal 32 may discharge second ink 115-1. In such an embodiment, the second ink 115-1 may be discharged at a position spaced apart about 1.5 um from the first reference line STL1 in the direction opposite to the second direction D2. In such an embodiment, the discharge waveform signal selector 400 may select the third discharge waveform signal 33, and may provide the third discharge waveform signal 33 to the third nozzle 103 based on the third bit string 423-1. Third ink 116-1 may be discharged to a position adjusted about 5 um in the direction opposite to the second direction D2 from the position where the third test ink 113-1 is discharged by discharging the third ink 116-1 from the third nozzle 103 provided with the third discharge waveform signal 33. That is, the third ink 116-1 may be discharged at a position spaced apart about 1 um from the first reference line STL1 in the second direction D2. Accordingly, all of the first to third ink 114-1, 115-1, 116-1 may be discharged within ±2.5 um of the first reference line STL1, and the inkjet printing system 10 may accurately control a position where the first to third ink 114-1, 115-1, 116-1 are discharged while maintaining the high transferring speed by controlling each of the first to third nozzles 101, 102 and 103 to discharge the first to third ink 114-1, 115-1, 116-1 at predetermined time interval.

In an alternative exemplary embodiment, the inkjet printing system 10 may generate the discharge position error data 420-1 in various different ways. In an exemplary embodiment of the inkjet printing system 10, as described above with reference to FIG. 1 to FIG. 6, the discharge frequency of the inkjet head 100 may be 30 kHz and the transferring speed of the pixel printing target substrate 210 may be 450 mm/s, but the invention is not limited thereto. Alternatively, the inkjet printing system 10 may have a discharge frequency among various discharge frequencies and a transferring speed among various transferring speeds according to desired conditions.

Figure 7:
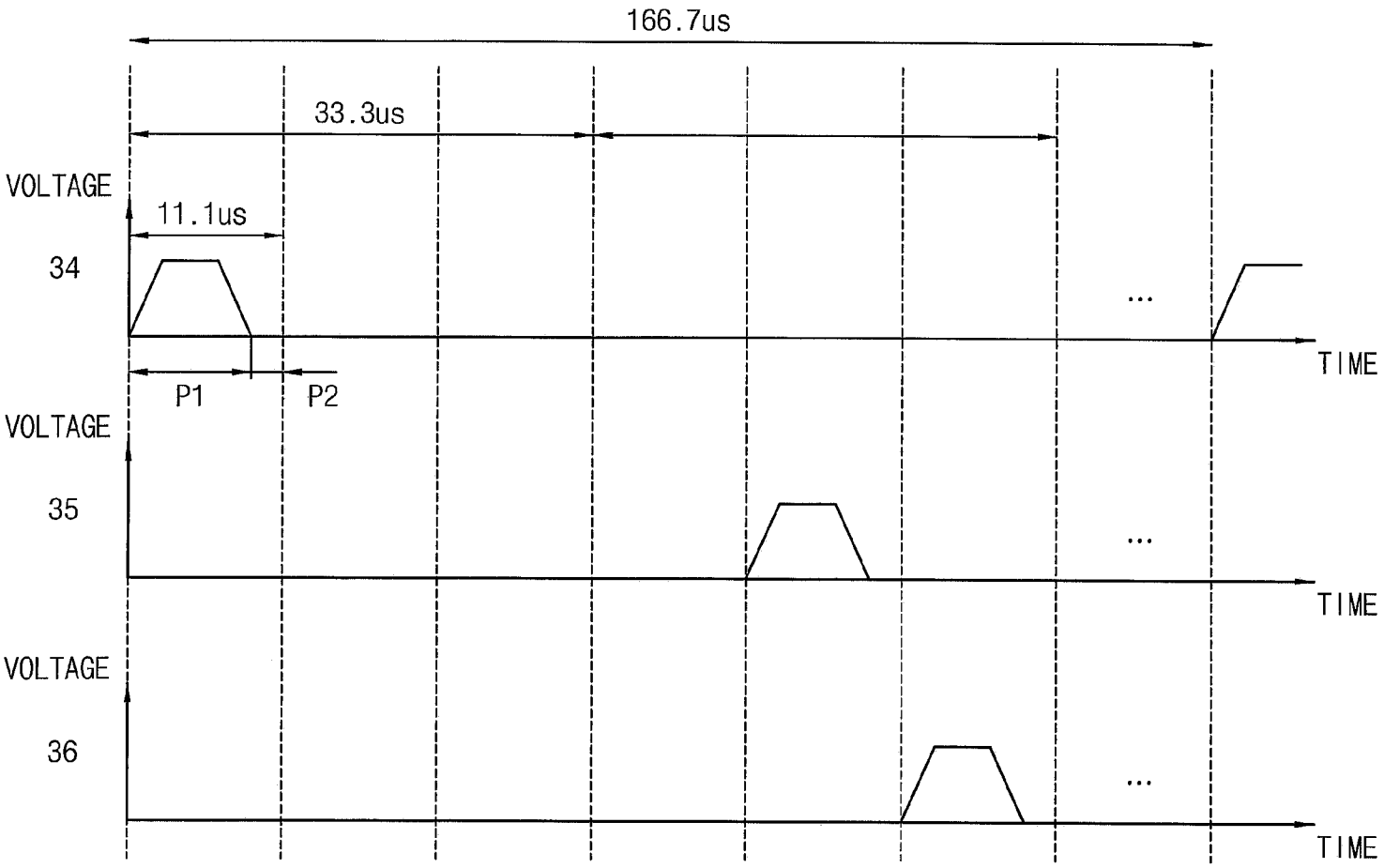
FIG. 7 is a waveform diagram illustrating an exemplary embodiment of a plurality of discharge waveform signals generated by the discharge waveform signal generator included in the inkjet printing system of FIG. 1A and FIG. 1B.
Figure 8:
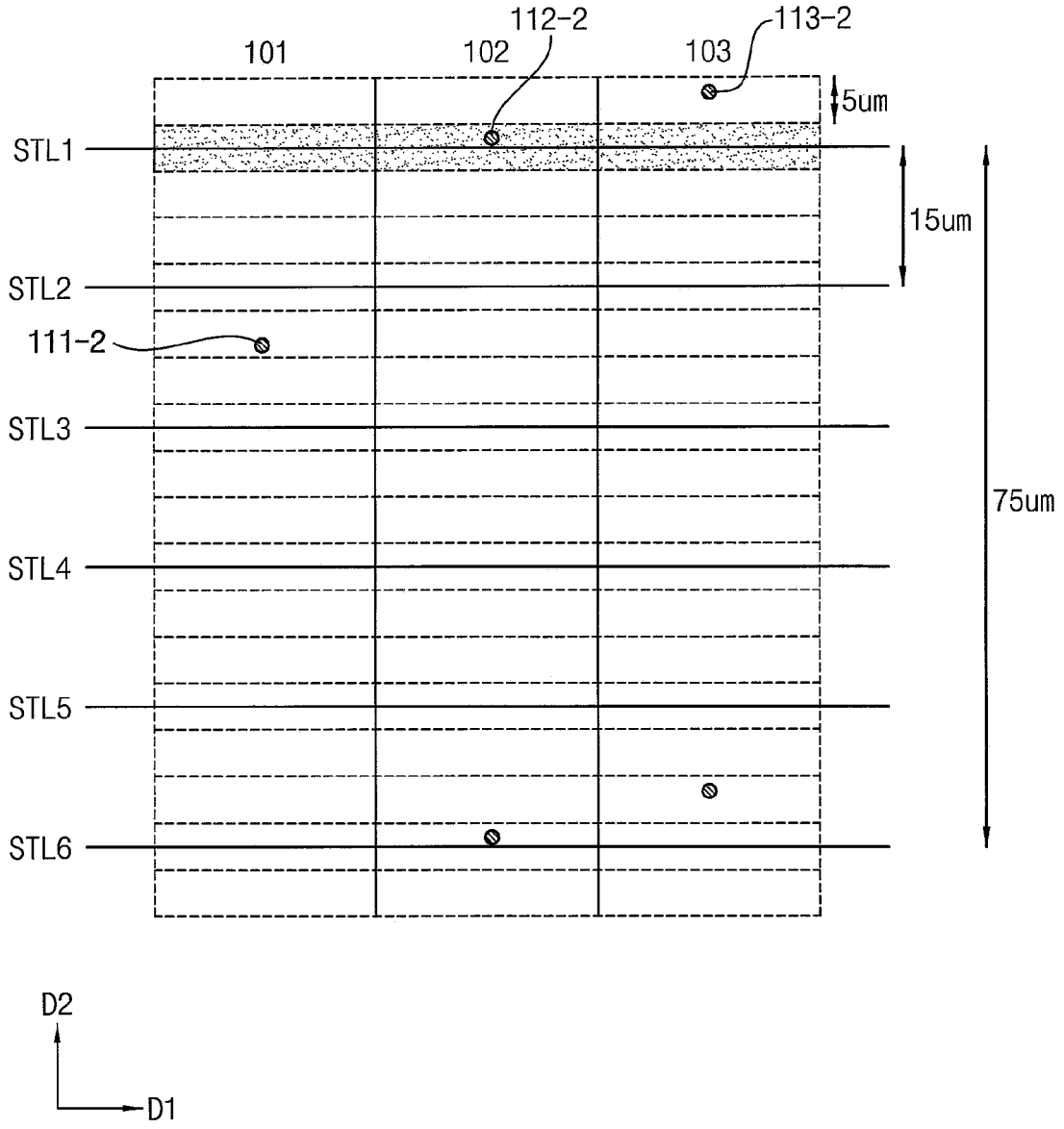
FIG. 8 is a diagram illustrating an exemplary embodiment of positions where test inks are discharged in the inkjet printing system of FIG. 1A and FIG. 1B.
Figure 9:
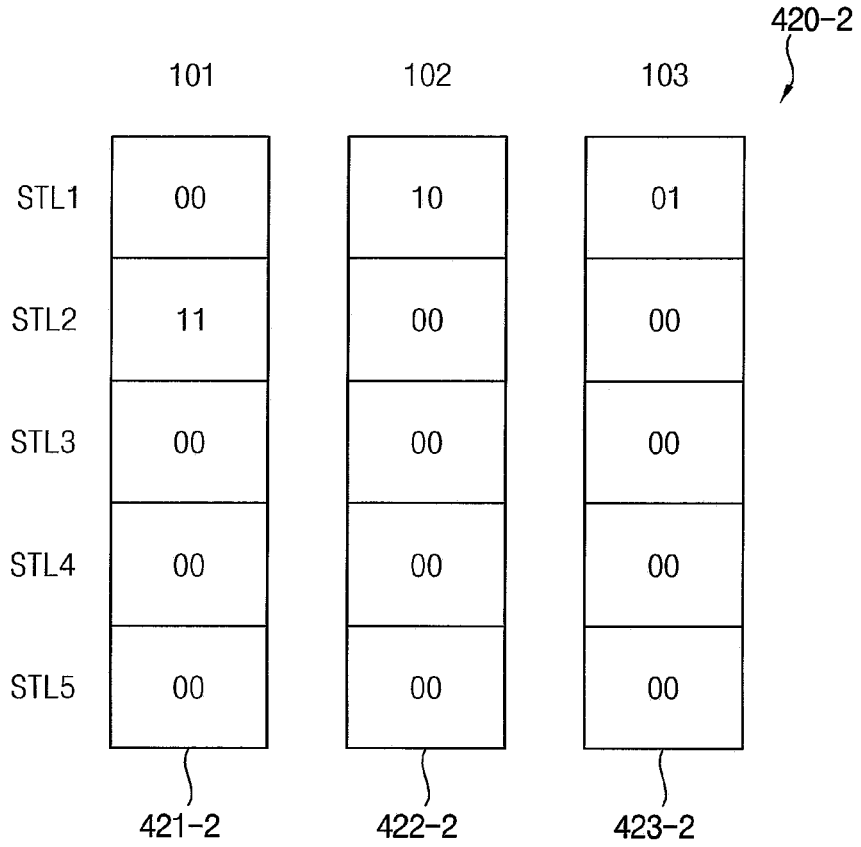
FIG. 9 is a diagram illustrating an exemplary embodiment of discharge position error data received by a discharge waveform signal selector included in the inkjet printing system of FIG. 1A and FIG. 1B.
Figure 10:
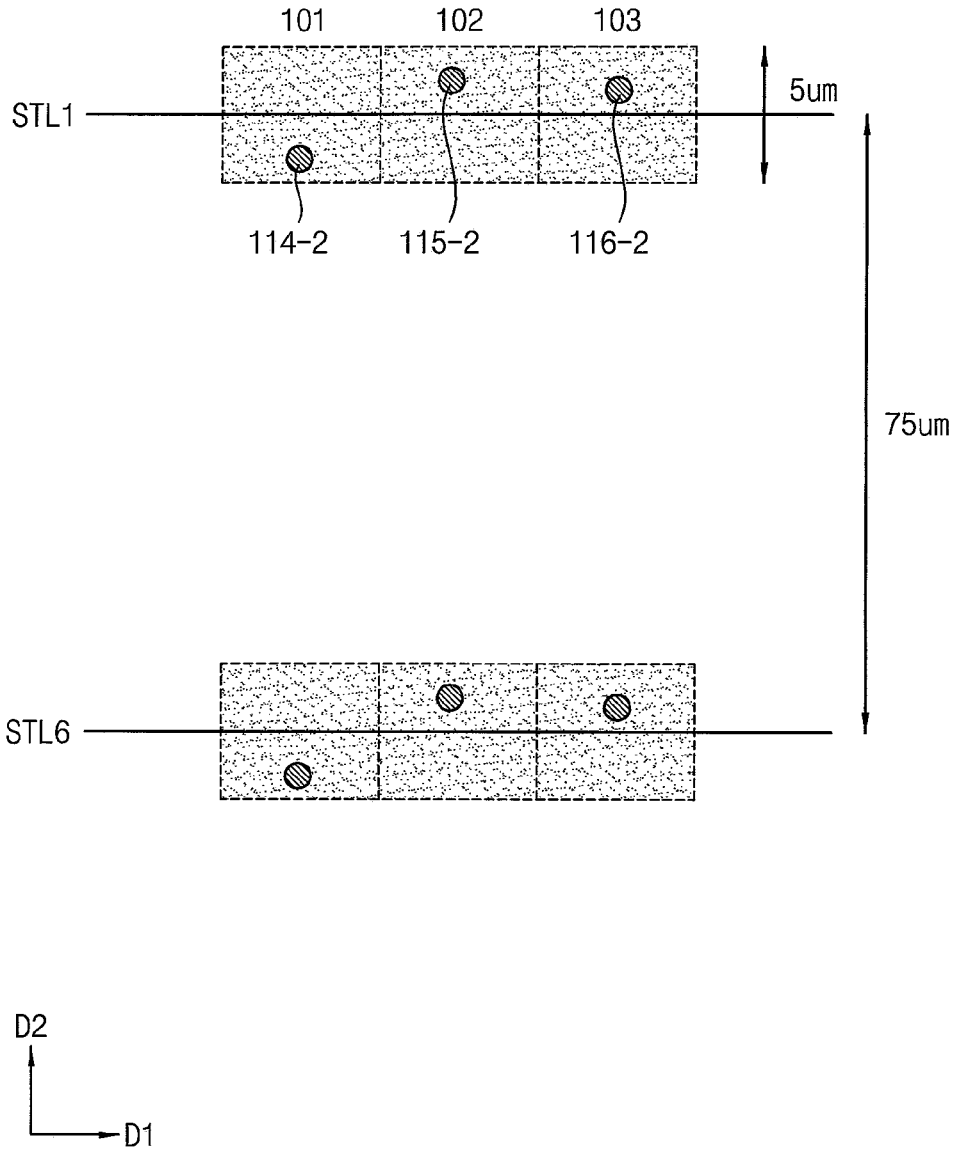
FIG. 10 is a diagram illustrating positions where actual inks are discharged in an exemplary embodiment of the inkjet printing system of FIG. 1A and FIG. 1B.

FIG. 7 is a waveform diagram illustrating an exemplary embodiment of a plurality of discharge waveform signals generated by the discharge waveform signal generator included in the inkjet printing system of FIG. 1A and FIG. 1B. FIG. 8 is a diagram illustrating an exemplary embodiment of positions where test inks are discharged in the inkjet printing system of FIG. 1A and FIG. 1B. FIG. 9 is a diagram illustrating an exemplary embodiment of discharge position error data received by a discharge waveform signal selector included in the inkjet printing system of FIG. 1A and FIG. 1B. FIG. 10 is a diagram illustrating position where actual inks are discharged in an exemplary embodiment of the inkjet printing system of FIG. 1A and FIG. 1B.

Referring to FIG. 1A, FIG. 1B, FIG. 7, FIG. 8, FIG. 9, and FIG. 10, in an exemplary embodiment, the pixel printing target substrate 210 may be the test substrate 211, and the test substrate 211 may be provided with first to sixth reference lines STL1, STL2, STL3, STL4, STL5 and STL6. Each of the first to sixth reference lines STL1, STL2, STL3, STL4, STL5 and STL6 may extend in the first direction D1, and may be arranged with regular intervals in the second direction D2. In an exemplary embodiment, the first to sixth reference lines STL1, STL2, STL3, STL4, STL5 and STL6 may be set for each minimum discharge interval. The minimum discharge interval may be calculated based on the discharge frequency of the inkjet head 100 and the transferring speed of the pixel printing target substrate 210. In one exemplary embodiment, for example, the minimum discharge interval may be about 15 um.

The first to third nozzles 101, 102 and 103 may simultaneously discharge first to third test inks 111-2, 112-2 and 113-2 toward the first reference line STL1. Next, the first to third nozzles 101, 102 and 103 may simultaneously discharge test inks toward the sixth reference line STL6. However, the positions where the first to third test inks 111-2, 112-2 and 113-2 are discharged to the test substrate 211 may be out of the first and sixth reference lines STL1 and STL6 by a variety reasons (for example, when the shapes of the first to third nozzles 101, 102 and 103 are different or the first to third nozzles 101, 102 and 103 are not aligned properly).

In an exemplary embodiment, as shown in FIG. 8, the first test ink 111-2 discharged from the first nozzle 101 may be discharged spaced apart from the second reference line STL2 about 7 um in a direction opposite to the second direction D2. The second test ink 112-2 discharged from the second nozzle 102 may be discharged spaced apart from the first reference line STL1 about 1.5 um in the second direction D2. The third test ink 113-2 discharged from the third nozzle 103 may be discharged spaced apart from the first reference line STL1 about 6 um in the second direction D2. This may be the same at the sixth reference line STL6. Hereinafter, the first to third test inks 111-2, 112-2 and 113-2 discharged toward the first reference line STL1 will be mainly described.

To manufacture a display device having high resolution, the ink 110 may be discharged within a predetermined margin of error in the first reference line STL1. In one exemplary embodiment, for example, the margin of error may be about ±2.5 um of the first reference line STL1.

Discharge position error data 420-2 may indicate a distance difference between the first to third test inks 111-2, 112-2 and 113-2 and each of the first to fifth reference lines STL1, STL2, STL3, STL4, STL5 in the second direction D2, and may respectively correspond to the first to third nozzles 101, 102 and 103. In an exemplary embodiment, the discharge position error data 420-2 may be a digital signal, and a reference bit string may be assigned to the first reference line STL1, and first to third bit string 421-2, 422-2 and 423-2 may be assigned to the first to third nozzles 101, 102 and 103 according to the distance difference.

In an exemplary embodiment, as shown in FIG. 9, the position where the first to third test inks 111-2, 112-2 and 113-2 are discharged onto the test substrate 211 may be converted into the discharge position error 420-2. The reference bit string and the first to third bit string 421-2, 422-2 and 423-2 of the discharge position error data 420-2 may be represented by two binary digits, respectively. In one exemplary embodiment, for example, the first bit string 421-2 of '00', '11', '00', '00', '00' corresponding to each of the first to fifth reference lines STL1, STL2, STL3, STL4 and STL5 may be assigned to the first nozzle 101 which discharges the first test ink 111-2, the second bit string 422-2 of '10', '00', '00', '00', '00' corresponding to each of the first to fifth reference lines STL1, STL2, STL3, STL4 and STL5 may be assigned to the second nozzle 102 which discharges the second test ink 112-2, and the third bit string 423-2 of '01', '00', '00', '00', '00' corresponding to each of the first to fifth reference lines STL1, STL2, STL3, STL4 and STL5 may be assigned to the third nozzle 103 which discharges the third test ink 113-2.

The discharge waveform signal selector 400 may select first to third discharge waveform signals 34, 35 and 36 for controlling discharge operations of the first to third nozzles 101, 102 and 103 based on the discharge position error data 420-2 respectively corresponding to the first to third nozzles 101, 102 and 103 among the different discharge waveform signals 30, and the discharge waveform signal selector 400 may provide the first to third discharge waveform signals 34, 35 and 36 to the first to third nozzles 101, 102 and 103. In an exemplary embodiment, the discharge waveform signal selector 400 may include first to third signal selection units 411, 412 and 413. Each of the first to third signal selection units 411, 412 and 413 may be a multiplexer which is inputted a plurality of signals and outputs one of them. The first to third signal selection units 411, 412 and 413 may receive the discharge position error data 420-2 respectively corresponding to the first to third nozzles 101, 102 and 103, and may select the first to third discharge waveform signals 34, 35 and 36 for controlling discharge operations of the first to third nozzles 101, 102 and 103 among the different discharge waveform signals 30. Next, the first to third signal selection units 411, 412 and 413 may selectively provide the first to third discharge waveform signals 31, 32 and 33 to the first to third nozzles 101, 102 and 103.

In such an embodiment, as shown in FIG. 10, the discharge waveform signal selector 400 may select the first discharge waveform signal 31, and may provide the first discharge waveform signal 34 to the first nozzle 101 based on the first bit string 421-2. First ink 114-2 may be discharged to a position adjusted about 20 um in the second direction D2 from the position where the first test ink 111-2 is discharged by discharging the first ink 114-2 from the first nozzle 101 provided with the first discharge waveform signal 34. That is, the first ink 114-2 may be discharged at a position spaced apart about 2 um from the first reference line STL1 in the second direction D2. In such an embodiment, the discharge waveform signal selector 400 may select the second discharge waveform signal 35 and may provide the second discharge waveform signal 35 to the second nozzle 102 based on the second bit string 422-2. The second nozzle 102 provided with the second discharge waveform signal 35 may discharge second ink 115-2. That is, the second ink 115-2 may be discharged at a position spaced apart about 1.5 um from the first reference line STL1 in the direction opposite to the second direction D2. In such an embodiment, the discharge waveform signal selector 400 may select the third discharge waveform signal 36, and may provide the third discharge waveform signal 36 to the third nozzle 103 based on the third bit string 423-2. Third ink 116-2 may be discharged to a position adjusted about 5 um in the direction opposite to the second direction D2 from the position where the third test ink 113-2 is discharged by discharging the third ink 116-2 from the third nozzle 103 provided with the third discharge waveform signal 36. That is, the third ink 116-2 may be discharged at a position spaced apart about 1 um from the first reference line STL1 in the second direction D2. Accordingly, all of the first to third ink 114-2, 115-2, 116-2 may be discharged within ±2.5 um of the first reference line STL1. In such an embodiment, although the first test ink 111-2 is discharged spaced apart from the first reference line STL1 about 22 um which is longer than 7.5 um in a direction opposite to the second direction D2, the first ink 114-2 may be discharged within ±2.5 um of the first reference line STL1. That is, the inkjet printing system 10 may discharge the first to third inks 114-2, 115-2, 116-2 within the margin of error in the first reference line STL1 because the discharge position error data 420-2 is effectively converted even if the first to third test inks 111-2, 112-2 and 113-2 are discharged at any position of the test substrate 211, by providing with reference lines at each minimum discharge interval.

However, the above description is merely exemplary, and reference lines in the inkjet printing system 10 may be variously set according to the desired conditions.

Figure 11A:
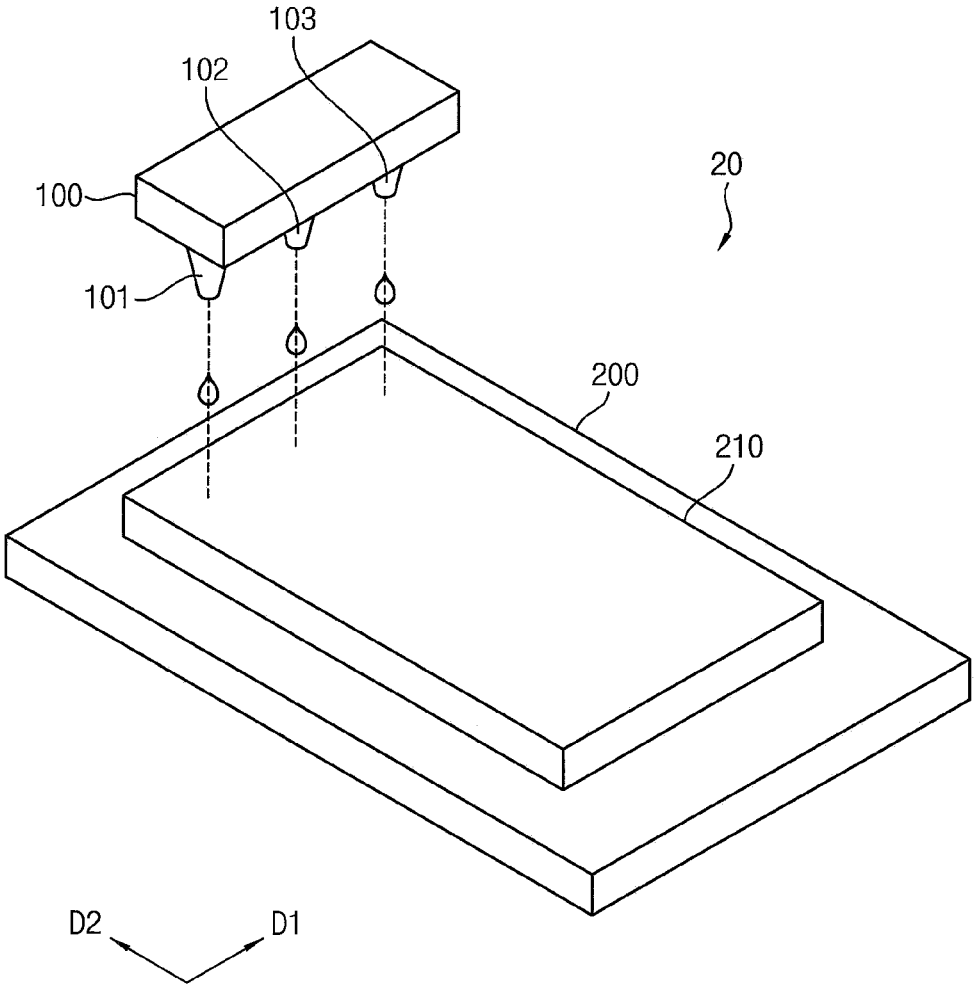
FIG. 11A and FIG. 11B are diagrams illustrating an inkjet printing system according to an exemplary embodiment.
Figure 11B:
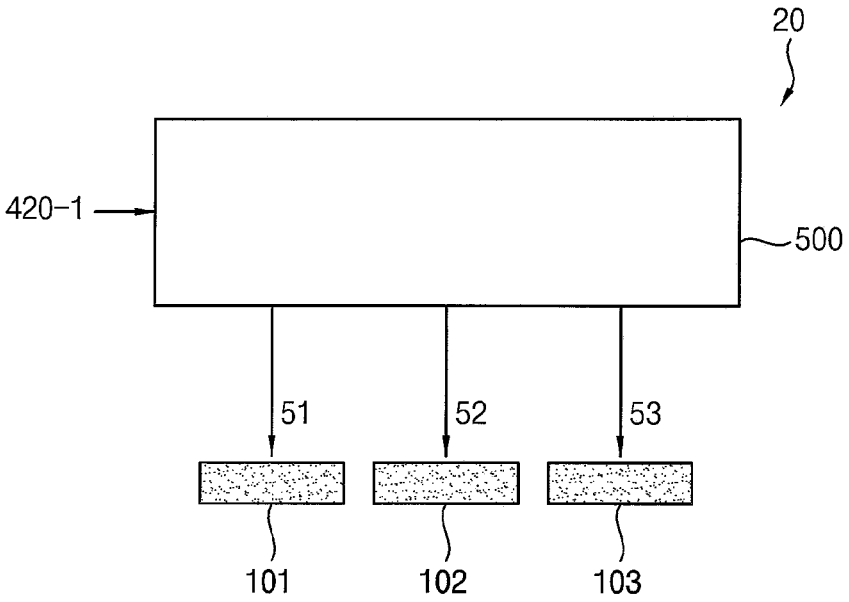
Figure 12:
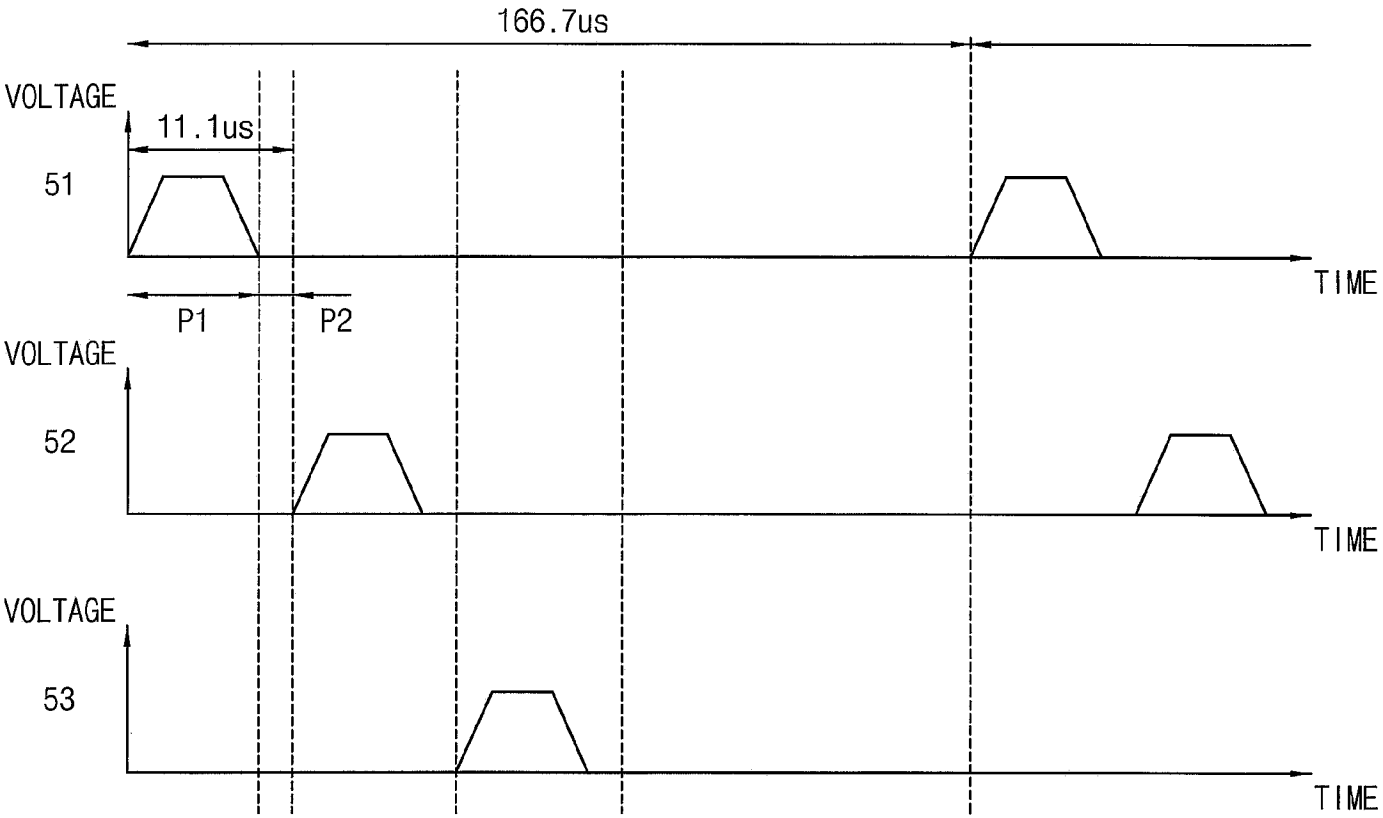
FIG. 12 is a waveform diagram illustrating an exemplary embodiment of a plurality of discharge waveform signals generated by a discharge waveform signal generator included in the inkjet printing system of FIG. 11A and FIG. 11B.

FIG. 11A and FIG. 11B are diagrams illustrating an inkjet printing system according to an exemplary embodiment. FIG. 12 is a waveform diagram illustrating an exemplary embodiment of a plurality of discharge waveform signals generated by a discharge waveform signal generator included in the inkjet printing system of FIG. 11A and FIG. 11B.

Referring to FIG. 11A, FIG. 11B and FIG. 12, the inkjet printing system 20 may include an inkjet head 100, a transfer part 200, and a discharge waveform signal generator 500. In FIGS. 11A and 11B, the inkjet printing system 20 is substantially the same as the inkjet printing system 10 shown in FIGS. 1A and 1B except for the discharge waveform signal generator 500, and any repetitive detailed description of the same or like elements will hereinafter be omitted or simplified.

The discharge waveform signal generator 500 may generate first to third discharge waveform signals 51, 52 and 53 based on the pixel interval in the pixel printing target substrate 210, a transferring speed of the pixel printing target substrate 210, and discharge position error data 420-1 respectively corresponding to the first to third nozzles 101, 102 and 103. In one exemplary embodiment, for example, the discharge waveform signal generator 500 may generate the first to third discharge waveform signals 51, 52 and 53 by dividing one discharge waveform signal, which is applied for the time spent for one droplet to be discharged after the previous droplet discharged from one nozzle, into a plurality of discharge waveform signals.

Each of the first to third discharge waveform signals 51, 52 and 53 may have an activating duration P1 and a stable duration P2 following the activating duration P1. The activating duration P1 may include a rising portion, a holding portion, and a falling portion. The ink 110 may be discharged from the nozzle receiving the discharge waveform signal. The stable duration P2 may be a time duration between an end of the activating duration P1 of a first discharge waveform signal and a start of the activating duration P1 of a second discharge waveform signal. That is, the activating duration P1 of one discharge waveform signal of the first to third discharge waveform signals 51, 52 and 53 may start after the stable duration P2 of the other discharge waveform signal finishes.

In an exemplary embodiment, the discharge waveform signal generator 500 may generate the first to third discharge waveform signals 51, 52 and 53 based on the pixel interval (e.g., about 75 um) and the transferring speed (e.g., about 450 mm/s). For example, the discharge waveform signal generator 500 may generate the first to third discharge waveform signals 51, 52 and 53 by dividing one discharge waveform signal applied for 33.3 us, which is the time required for one droplet to be discharged after the previous one to be discharged from one nozzle, into three discharge waveform signals. That is, as shown in FIG. 12, each of the first to third discharge waveform signals 51, 52 and 53 may start the activating duration P1 every 166.7 us, and may have the activating duration P1 and the stable duration P2 for 11.1 us.

In an exemplary embodiment, as shown in FIG. 12, the discharge waveform signal generator 500 generates the first to third discharge waveform signals, but the invention is not limited thereto. Alternatively, the discharge waveform signal generator 500 may generate four or more discharge waveform signals in consideration of the characteristic of the ink 110. In an exemplary embodiment, the length of the activating duration P1 and/or the stable duration P2 may be variously modified or controlled, e.g., to be shortened or extended from those shown in FIG. 12.

The discharge waveform signal generator 500 may provide the first to third discharge waveform signals 51, 52 and 53 to the first to third nozzles 101, 102 and 103. In such an embodiment, the discharge waveform signal generator 500 is substantially the same as that described above, and any repetitive detailed description thereof will be omitted.

The invention should not be construed as being limited to the exemplary embodiments set forth herein. Rather, these exemplary embodiments are provided so that this disclosure will be thorough and complete and will fully convey the concept of the invention to those skilled in the art. The exemplary embodiments of the inkjet printing system 10 and 20 may be used in manufacturing process of hole transport layer and/or hole injection layer, and may be used in manufacturing process of liquid crystal and/or color filter of liquid crystal display device.

The exemplary embodiments of the inkjet printing system 10 and 20 according to the invention may be applied to an display device or an electronic device including the display device, for example, a cellular phone, a smart phone, a video phone, a smart pad, a smart watch, a tablet personal computer ("PC"), a car navigation system, a television, a computer monitor, a laptop computer, a head mounted display device or an MP3 player.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. An inkjet printing system comprising:

an inkjet head comprising first to n-th nozzles disposed in a row in a first direction, wherein the inkjet head discharges an ink onto a pixel printing target substrate, and n is an integer equal to or greater than two;

a transfer part which transfers the pixel printing target substrate toward the inkjet head in a second direction perpendicular to the first direction;

a discharge waveform signal generator which generates a plurality of different discharge waveform signals based on a pixel interval in the pixel printing target substrate and a transferring speed of the pixel printing target substrate; and a discharge waveform signal selector which selects first to n-th discharge waveform signals among the plurality of different discharge waveform signals based on discharge position error data respectively corresponding to the first to n-th nozzles, such that the first to n-th discharge waveform signals are selectively provided to each of the first to n-th nozzles, wherein the first to n-th discharge waveform signals control discharge operations of the first to n-th nozzles.

2. The inkjet printing system of claim 1, wherein the discharge position error data represent a distance difference between a test ink simultaneously discharged from the first to n-th nozzles toward a reference line extending in the first direction and the reference line, in the second direction.

3. The inkjet printing system of claim 2, wherein the discharge position error data is a digital signal, wherein a reference bit string is assigned to the reference line, and wherein first to n-th bit strings are assigned to the first to n-th nozzles, respectively, based on the distance difference.

4. The inkjet printing system of claim 2, wherein the reference line is set for the pixel interval.

5. The inkjet printing system of claim 2, wherein the reference line is set for each minimum discharge interval calculated based on a discharge frequency of the inkjet head and the transferring speed of the pixel printing target substrate.

6. The inkjet printing system of claim 1, wherein each of the plurality of different discharge waveform signals has an activating duration and a stable duration following the activating duration; and wherein when the stable duration of a first discharge waveform signal finishes, the activating duration of a second discharge waveform signal starts.

7. The inkjet printing system of claim 1, wherein the discharge waveform signal selector comprises first to n-th signal selection units which select the first to n-th discharge waveform signals.

8. The inkjet printing system of claim 7, wherein the discharge position error data of the first to n-th nozzles are respectively applied to the first to n-th signal selection units.

9. The inkjet printing system of claim 1, wherein the inkjet head further comprises first to n-th piezoelectric elements disposed corresponding to the first to n-th nozzles, respectively; and wherein shapes of the first to n-th piezoelectric elements are varied in response to the first to n-th discharge waveform signals, respectively.

10. An inkjet printing system comprising:

an inkjet head comprising first to n-th nozzles disposed in a row in a first direction, wherein the inkjet head discharges an ink onto a pixel printing target substrate, and n is an integer equal to or greater than two;

a transfer part which transfers the pixel printing target substrate toward the inkjet head in a second direction perpendicular to the first direction; and a discharge waveform signal generator which generates first to n-th discharge waveform signals based on a pixel interval in the pixel printing target substrate, a transferring speed of the pixel printing target substrate and discharge position error data respectively corresponding to the first to n-th nozzles, such that the first to n-th discharge waveform signals are selectively provided to each of the first to n-th nozzles.

11. The inkjet printing system of claim 10, wherein the discharge position error data represent a distance difference between a test ink simultaneously discharged to a reference line extending in the first direction from the first to n-th nozzles and the reference line, in the second direction.

12. The inkjet printing system of claim 11, wherein the discharge position error data is a digital signal, wherein a reference bit string is assigned to the reference line, and wherein first to n-th bit strings are respectively assigned to the first to n-th nozzles based on the distance difference.

13. The inkjet printing system of claim 11, wherein the reference line is set for the pixel interval.

14. The inkjet printing system of claim 11, wherein the reference line is set for each minimum discharge interval calculated based on a discharge frequency of the inkjet head and the transferring speed of the pixel printing target substrate.

15. The inkjet printing system of claim 10, wherein each of the first to n-th discharge waveform signals has an activating duration and a stable duration following the activating duration; and wherein when the stable duration of the first discharge waveform signal finishes, the activating duration of the second discharge waveform signal starts.

16. The inkjet printing system of claim 10, wherein the inkjet head further comprises first to n-th piezoelectric elements disposed corresponding to the first to n-th nozzles, respectively; and wherein shapes of the first to n-th piezoelectric elements are varied in response to the first to n-th discharge waveform signals, respectively.

* * * * *